US006620578B2

(12) United States Patent
Twist

(10) Patent No.: US 6,620,578 B2
(45) **Date of Patent: *Sep. 16, 2003**

(54) PROCESSING PHOTOGRAPHIC MATERIAL

(75) Inventor: Peter J. Twist, Lee Common Great Missenden (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/012,673

(22) Filed: Oct. 30, 2001

(65) Prior Publication Data

US 2002/0102503 A1 Aug. 1, 2002

(30) Foreign Application Priority Data

Nov. 3, 2000 (GB) ..... 0026955

(51) Int. Cl.[7] ..... G03C 5/29; G03C 7/409
(52) U.S. Cl. ..... 430/403; 430/434
(58) Field of Search ..... 430/403, 434

(56) References Cited

U.S. PATENT DOCUMENTS 4,121,237 A 10/1978 Schwartz ..... 354/323

FOREIGN PATENT DOCUMENTS

| | | |
|---|---|---|
| EP | 0 456 210 A2 | 11/1991 |
| EP | 0 716 343 A1 | 6/1996 |
| EP | 0 916 998 A1 | 5/1999 |
| JP | 1096653 A | 4/1989 |

OTHER PUBLICATIONS

U.S. Ser. No. 09/931,315, "Three–Part Concentrated Photographic Color Developing Kit and Methods of Use"0 by S.E. Haye & J.M. Huston, filed Aug. 16, 2001 (D–82537).

*Primary Examiner*—Hoa Van Le

(57) ABSTRACT

A method for processing a silver halide photographic material comprises the steps of loading the material into a chamber adapted to hold the material therein, introducing a metered amount of a first processing solution into the chamber, processing the photographic material with the first processing solution, introducing a metered amount of a second processing solution which is other than a second part of the first processing solution into the chamber without removing the first processing solution so that at least part of the total volume of the second processing solution is provided by the first processing solution and processing the photographic material with the second processing solution, the total volume of solution for each processing stage being spread over the whole area of the photographic material in a repetitive manner to enable uniform processing.

17 Claims, 7 Drawing Sheets

PROCESSING PHOTOGRAPHIC MATERIAL

FIELD OF THE INVENTION

This invention relates to a method for processing photographic material. In particular, the invention relates to a method of processing which uses a low volume of processing solution.

BACKGROUND OF THE INVENTION

Conventional processing of photographic material requires the use of large tanks of processing solutions. Each tank contains a processing solution such as developer, bleach, fixing solution or washing solution. The material is transported through each tank in turn, typically in a sinusoidal manner. There is a tendency for the solutions to carry over from one tank to another leading to pollution of the solutions. Conventional processing has several other drawbacks. The temperatures which can be utilised are limited and therefore the process is slow. The composition of the solutions must be stable over long time periods in the processing tanks. Replenishment of the solutions is difficult to control. The processing apparatus is also very large due to the number of processing tanks.

An alternative process uses a single tank which is filled with the first processing solution, emptied, filled with a second processing solution and so on until the process is completed. Again, this process uses relatively large volumes of processing solution and contamination of one solution by another needs to be carefully avoided.

To overcome the problems of conventional deep tank processing surface application of the processing chemicals was developed. In previous surface application methods a volume of solution is applied to the surface of the material being processed. However, previous surface application methods have several drawbacks. If the solution applied to the material is just left on the material in a static condition the processing will be very slow and inefficient because there is no agitation and by-products accumulate in the material layers and slow down processing. This method is also prone to non-uniformity of processing.

It is also known to process a photographic material within a rotary tube. The material to be processed is placed emulsion side facing inwards within the tube. Solution is added and the tube rotated. Large volumes of processing solution (750 ml/m$^2$ and upwards) will process the material effectively so long as rotation is not so fast as to cause dispersion of the solution puddle. Rapid rotation of the device is however very desirable to quickly and evenly distribute a given small volume of solution over the whole surface of the material so that processing is uniform from one end to the other. If the rotation is too slow there will be seasoning of the small volume of solution by the front end of the material and processing will be different at the back end of the material. Small volumes of processing solution (540 ml/m$^2$ or less) do not properly process film or paper because when the device is rotated, even at low speeds of rotation, the solution puddle is dispersed and spread over the whole surface of the material. Consequently there is no agitation. This leads to several processing defects. Processing is streaky, non-uniform and also slow because of local consumption and the accumulation of by-products. There is no surface mixing and chemical economy is therefore low.

In color negative film processing carried out in small continuous processors or "minilabs" the film passes through each stage of the process and from one tank of processing solution to the next tank of processing solution in a sinusoidal manner. The C-41RA process has the following process cycle and replenishment volumes, see Z-131 Manual "Using Kodak Flexicolor Chemicals":

Process C-41RA

| Stage | Replenishment volume(ml/linear meter) |
|---|---|
| Developer | 19(543 ml/m$^2$) |
| Bleach | 4.5(128.6 ml/m$^2$) |
| Fixer | 32(914.6 ml/m$^2$) |
| Stabiliser | 36(1028.8 ml/m$^2$) |
| Total | 91.4((2612 ml/m$^2$) |

Another process which uses even smaller volumes to replenish uses the Kodak Flexicolor SM Chemicals, see Manual Z-101, "Using Kodak SM Chemcials in SM Minilabs".

Process C-41SM

| Stage | Replenishment volume(ml/linear meter) |
|---|---|
| Developer | 12.87(367.8 ml/m$^2$) |
| Bleach | 2.7(77 ml/m$^2$) |
| Fixer | 15.1(431.5 ml/$^2$) |
| Stabiliser | 27.3(780 ml/m$^2$) |
| Total | 57.97(1656.7 ml/m$^2$) |

where ml/linear meter refers to ml/linear meter of 35 mm film. These volumes are representative of the smallest volumes needed to process film in existing commercial processors. The processing tanks used in a "minilab" processor are usually within the range of 3 to 20 liters volume for each tank depending on the individual design. In Process C-41SM the developer stage has one tank, the bleach stage has one tank, the fixer stage consists of two tanks and the stabiliser stage consists of three tanks. This gives the total number of tanks as seven. It can be seen that each processing solution is in at least one separate tank and the film passes sequentially through these tanks.

Contamination of a given tank of processing solution by carry-over from a previous tank of processing solution is inevitable in a conventional processor. It is usual practice to minimise contamination due to carry-over by providing squeegee rollers before the cross over. Accidental contamination of one processing solution will sometimes occur by splashing or careless filling of a processor. Contamination of the developer solution by fixer solution or bleach solution must be avoided since otherwise the performance and stability of the developer solution will be seriously reduced even to the point of being unacceptable. In the conventional processing method it is possible to generate unacceptable colored stains if the developer solution is contaminated with bleach or fix solution. Such unacceptable colored stains can arise from quite moderate amounts of contamination. For example, a few ml of fixer solution per liter of developer solution can increase the stain level so that the process is unacceptable.

PROBLEM TO BE SOLVED BY THE INVENTION

It is an aim of the invention to reduce the total volume of processing solutions used to process a photographic material.

SUMMARY OF THE INVENTION

The invention provides a method for processing a silver halide photographic material comprising the steps of loading the material into a chamber adapted to hold the material therein, introducing a metered amount of a first processing solution into the chamber, processing the photographic material with the first processing solution, introducing a metered amount of a second processing solution which is other than a second part of the first processing solution into the chamber without removing the first processing solution so that at least part of the whole volume of the second processing solution is provided by the first processing solution and processing the photographic material with the second processing solution, the whole volume of solution for each processing stage being spread over the whole area of the photographic material in a repetitive manner to enable uniform processing.

ADVANTAGEOUS EFFECT OF THE INVENTION

By making use of the volume of a preceding solution to conserve the total volume of processing solutions used, the total volume of processing solutions used to process a photographic material is very low. A first processing solution having a volume similar to the standard replenishment volume may be used to process a photographic material in a small volume single use processor. Under normal circumstances, the volume remaining after the first stage of such a single use process would be discarded. In the present invention, this volume is left in the tank and a concentrated solution of the next processing solution is added to it in order to convert it into the second processing solution. The second processing solution may then be converted into a third processing solution by the addition of another concentrated solution again without removal of the second processing solution, and so on until the wash stage is reached.

DETAILED DESCRIPTION OF THE INVENTION

Figure 1B:
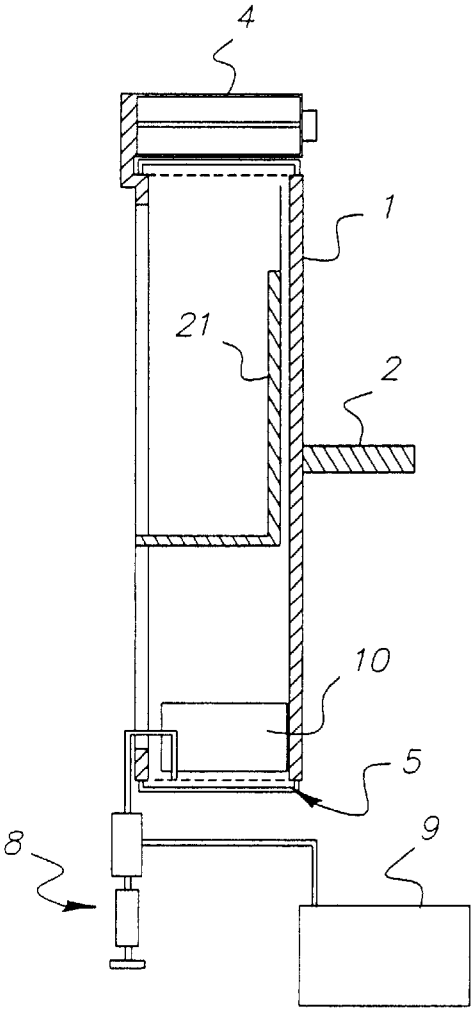
FIGS. 1A and 1B show a schematic side view and section view, respectively, of apparatus in which the method of the present invention can be performed.

While at least two processing steps are carried out using the merged solution process of the invention, it will be appreciated that one or more additional processing steps can be carried out in the same manner. Also, reference to a first processing solution in the method of the invention does not necessarily refer to the first processing solution used in the method. In other words, the invention may be used in respect of all or some of the processing steps. Further, it is known that in certain methods for processing a photographic material a processing solution may be added in two separate parts e.g. a two part developer. The merged solution method of the invention does not include a method in which only two solutions are merged, said solutions being parts of a two part processing solution. On the other hand, the method of the invention does not exclude the use of two (or more) part processing solutions provided that a further processing solution is merged therewith.

Therefore, in a further embodiment of the invention, the method further comprises, after processing the photographic material with the second processing solution, introducing a metered amount of a third processing solution into the chamber without removing any processing solution remaining from the preceding processing solution or solutions so that at least part of the total volume of the third processing solution is provided by the preceding processing solution or solutions and processing the photographic material with the third processing solution.

Also, in a further embodiment of the invention, the method further comprises, after processing the photographic material with the third processing solution, introducing a metered amount of a fourth processing solution into the chamber without removing any processing solution remaining from the preceding processing solution or solutions so that at least part of the total volume of the fourth processing solution is provided by the preceding processing solution or solutions and processing the photographic material with the fourth processing solution. Using the merged solution processing method of the invention it is possible to add all the processing solutions except the wash solution on top of one another in the correct sequence without removing the previous solution. Thus the whole of the previous solution is mixed with the next solution. The method is preferably carried out in a high agitation single use processor which processes one film at a time with small volumes similar to those used to replenish continuous processors with tanks of several liters. Thus a developer solution may be added to the tank of the single use processor and after development is complete a bleach solution, for example, is added to the developer solution to transform the developer into a bleach solution, then a fix solution is added to the developer plus bleach solution to convert it into a bleach-fix solution. The previous solution acts as a diluent for the next solution which means that the next solution can be more concentrated than it would be if it were used alone. This means that the total volume used in the process can be less than that used if each solution is removed after the particular stage it performs is complete.

When a developer solution is used in the merged process its developing activity must be arrested by the next solution added otherwise stain and low contrast can result. The second solution after the developer can be a stop solution, a bleach solution, a bleach-fix solution, a fix solution or a stop/fix solution. Once the development has been completed and the second solution has been added subsequent solutions do not need to be arrested, so it is possible for the second and third solution to have dual functions as long as this is not development. If the process cycle is develop, bleach, fix, wash then as soon as the fix solution is added the bleach solution becomes a bleach-fix solution.

In a particular embodiment, the first processing solution is a developer solution and the second processing solution is a stop solution. A bleach solution may be used as a third processing solution. The bleach solution may be followed by a fix or bleach-fix solution as a fourth processing solution.

In another embodiment, the first processing solution is a developer solution and the second processing solution is a stop-fix or fix solution. A bleach solution may be used as a third processing solution.

In a further embodiment, the first processing solution is a developer solution and the second processing solution is a stop-bleach or bleach solution. A bleach-fix or fix solution may be used as a third processing solution.

Alternatively, the first processing solution may be a developer solution and the second processing solution may be a bleach-fix solution.

In a particular embodiment of the invention, the second processing solution can be made by adding the required formulation as a solid to the first processing solution. Similarly, subsequent processing solutions can be made by adding a solid to the preceding processing solution. When the steps carried out by merged solution processing are complete, the remaining processing solution is discarded. The steps carried out in accordance with the invention may be preceded, interrupted or followed by processing steps carried out in other ways e.g. deep tank processing and surface application processing. Preferably, the processing steps will be terminated by one or more wash steps.

Thus, for example, the method of the invention may be a single use process in which it is possible to convert a developer solution into a stop solution, and a stop solution into a bleach solution, and a bleach solution into a bleach-fix or fix solution wherein a substantial part of the total volume is the volume of the developer or first solution and wherein each previous solution is not removed until before the wash stage.

By using concentrated solutions, typically having the strength of a replenishment solution used in conventional processing, the method of the invention can be carried out with very low volumes of solution.

The amounts of processing solution used will vary depending on the type of photographic material being processed.

For color negative film processing, the amount of the first processing solution may be from 50 to 2850 ml/m$^2$, preferably from 140 to 1170 ml/m$^2$.

The amount of the second processing solution introduced may be sufficient to provide an additional volume of from 6 to 2000 ml/m$^2$, preferably from 20 to 800 ml/m$^2$.

The amount of any subsequent processing solution introduced in the merged solution processing method of the invention may be sufficient to provide an additional volume of from 6 to 2000 ml/m$^2$, preferably from 20 to 80 ml/m$^2$.

For color print e.g. paper processing, the amount of the first processing solution may be from 30 to 400 ml/m$^2$, preferably from 45 to 150 ml/m$^2$.

The amount of the second processing solution introduced may be sufficient to provide an additional volume of from 1 to 220 ml/m$^2$, preferably from 10 to 100 ml/m$^2$.

The amount of any subsequent processing solution introduced in the merged solution processing method of the invention may be sufficient to provide an additional volume of from 1 to 220 ml/m$^2$, preferably from 10 to 100 ml/m$^2$. The development step may be carried out for a period from 15 to 195 seconds, preferably from 30 to 90 seconds, at a temperature of 20 to 80° C., preferably from 35 to 60° C. Development may be followed by a stop step carried out for a period from 5 to 60 seconds, preferably from 10 to 30 seconds, at a temperature of 20 to 80° C., preferably from 35 to 60° C. A bleach step may follow for a period from 15 to 240 seconds, preferably from 30 to 60 seconds, at a temperature of 20 to 80° C., preferably from 35 to 60° C. A fix step may follow for a period from 15 to 240 seconds, preferably from 30 to 90 seconds, at a temperature of 20 to 80° C., preferably from 35 to 60° C.

Alternatively, stop/fix or fix step may follow the development step for a period from 15 to 240 seconds, preferably from 10 to 60 seconds, at a temperature of 20 to 80° C., preferably from 35 to 60° C. A bleach step may follow for a period from 10 to 240 seconds, preferably from 15 to 90 seconds, at a temperature of 20 to 80° C., preferably from 35 to 60° C.

The above processing steps may be followed by a wash step carried out for a period from 10 to 120 seconds, preferably from 30 to 60 seconds, at a temperature of 20 to 80° C., preferably from 35 to 60° C.

The merged solution processing method of the invention may be used for any photographic silver halide material including color negative or positive film or paper, color paper, reversal or black and white film or paper.

Further information regarding the composition of a variety of photographic materials suitable for use in the present invention may be found in Section XI–XIV of Research Disclosure of September 1994 No 365 at pages 46–50.

Details of the development of photographic materials including examples of developing agents, preservatives, antifoggants, sequestering agents and other additives may be found in Section XIX of Research Disclosure of September 1994 No 365 at pages 60–62.

Details of desilvering, washing, rinsing and stabilizing of photographic materials including bleaching, fixing, bleach-fixing, washing, rinsing and stabilizing solutions may be found in Section XX of Research Disclosure of September 1994 No 365 at pages 63–66. The merged solution method of the invention differs significantly from the conventional process. In the merged process it is the intention, for example, to contaminate the developer with the next processing solution such that the function of the developer ceases, that is, no further development occurs and the function of the next processing solution commences. It is the purpose of the merged process to add sufficient quantity of the next solution so that development ceases immediately and no stain is generated. Stain is generated in conventional processors by moderate contamination where development is still proceeding and the development is accompanied by fixing or bleaching at the same time. When this happens fixer contamination can cause stain by physical development and it can also cause loss of contrast by prematurely fixing silver halide before the image is properly developed. Moderate amounts of bleach components in the developer solution can also cause stain by oxidising developing agent in a non-imagewise manner which generates blanket formation of image dye irrespective of the image dye of the original. In the merged process the addition of sufficient fixer or bleach components arrests development rapidly so that no further development occurs and no oxidation of developing agent occurs and so no stain occurs. This method is clearly not possible in large tank minilabs because the developer, bleach and fix solutions need to remain separate and fully functional. The merged solution method may be used in a single use process because the solutions are disposed of before the next film is processed.

The first stage in a color negative process is usually the development stage although a conditioner or pre-development stage can be used. The first stage in the merged process can be a development stage or a pretreatment stage. In the following Examples, the first stage is a development stage and the second solution can be a stop solution, a bleach solution, a fix solution, a stop/fix solution or a bleach-fix solution or any other solution that can be added to the developer solution to perform another stage in the process while at the same time giving an acceptable image. A stop solution stops development by rapidly lowering the pH of the mixture below that at which development occurs. A bleach solution also stops development by rapidly lowering the pH of the mixture. A fixer when added to the developer solution can stop development by fixing or dissolving all the silver halide. A stop/fix solution is simply a low pH fix solution that stops development by lowering pH and as well as by fixing silver halide.

The method of the invention may employ small volumes similar to those used for the replenishment of large processing tanks in conventional processors and shown in C-41RA and C-41SM Processes described above. Thus large tanks of standing solutions which have to be maintained on a daily basis are eliminated. In the method of the invention only one small tank is necessary and the entire process may be carried out in the same processing chamber. The volumes used are small enough to be disposed of after a film has been processed. Thus the process is a single use process. By using the method of the invention, further lowering of the total volumes required to process film by known single use processes can be achieved. It has been shown in the following Examples of the present invention that the merged process carried out in a single use processor can actually process film in total volumes less than the total volume required to replenish a conventional large tank processor for the same film.

The method of the invention may be performed in a single use wave processor of the type disclosed in co-pending application no GB 0023091.2, filed on Sep. 20, 2000. The processor comprises an apparatus for processing a photographic material, comprising a chamber adapted to hold the material therein, means for introducing a metered amount of solution into the chamber, means for removing the solution from the chamber, means for rotating the chamber and means for sweeping the surface of the material at each rotation of the chamber, thereby to form a wave in the solution through which the material may pass.

Figure 1A:
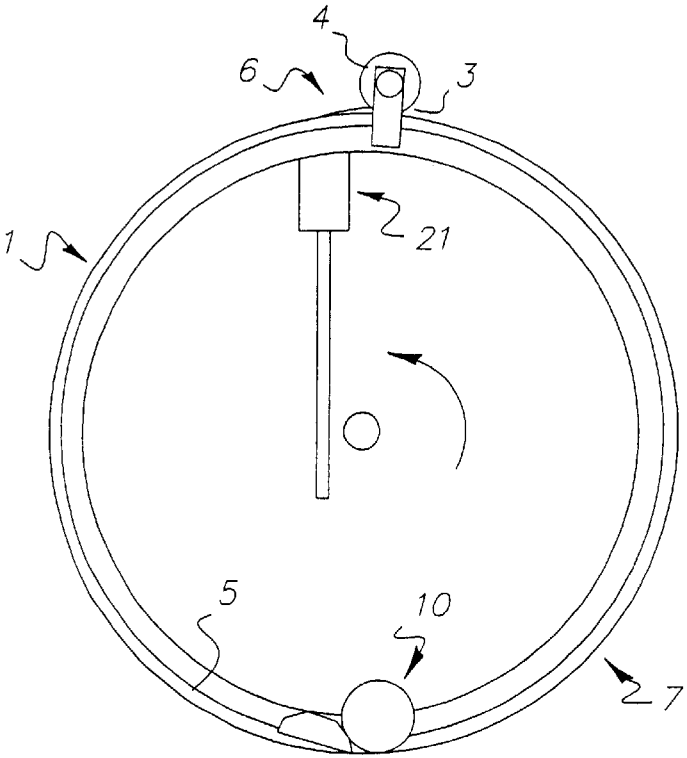

FIGS. 1A and 1B show a single use wave processor.

The wave processor comprises a cylinder 1 having at least one open end. The cylinder may be made of stainless steel, plastics or any other suitable material. A transparent material, such as polycarbonate, may be used if it is desired to scan the material while it is within the cylinder. The cylinder defines a processing chamber. An arm 3 is provided on the outer side of the cylinder for holding a film cassette 4. A slot 6 with a water tight cover (not shown) is provided through the wall of the cylinder to allow the strip of film 5 from the film cassette to enter the processing chamber. The watertight cover may be in the form of a hinged door having a rubber wedge. However, any suitable means may be used. A circular slot is defined around the inner circumference of the chamber for holding the strip of film 5 by the edges.

A second arm 21 is located within the chamber. This arm 21 grabs the tongue of the film and holds it against the inner circumference of the chamber. A close fitting cover (not shown) may be provided around the inner circumference of the chamber which sits above the film surface by at least 0.5 mm. This cover provides at least three functions to improve the performance of the apparatus. Firstly it lowers water evaporation which can cause a temperature drop and can concentrate the processing solution as processing is occurring. Secondly, it can itself provide agitation by maintaining a puddle of solution in the gap between the cover and the film surface at the lowest point of the chamber. Thirdly it provides a film retaining means making edge guides unnecessary, although edge guides can be also be provided to prevent the film sticking to the cover. It allows both 35 mm film and APS film (24 mm) to be loaded in the same apparatus and it also allows any length of film to be loaded. The material of the cover can be impervious to processing solution and as such is provided with a break or gap in its circumference so that the two extreme ends of the cover do not meet and through which processing solution is added to the film surface. In this embodiment the cover is fixed and rotates with the chamber as the chamber rotates. In another embodiment the cover is not fixed and rests on rails on each side which allow the cover to slide and remain stationary as the chamber rotates. In this embodiment the cover is again provided with a break or gap in its circumference so that processing solutions can be added to the film surface. In this embodiment a roller can also be provided which sits in the gap in the circumference of the cover and which remains essentially at the lowest point of the chamber. The roller provides additional agitation. In another embodiment the cover can be made of a material which is porous to processing solution such as a mesh material or a material punctured with holes. The cover can be made of plastic, metal, or any suitable material. However, the cover is not an essential feature of the invention.

A drive shaft 2 is provided at the closed end of the cylinder for rotation thereof. The open end of the cylinder 1 is provided with a flange 7. The flange retains solution within the chamber. In the embodiment shown in FIG. 1B the processing solutions are introduced into and removed from the chamber by means of syringes 8. However any suitable means may be used, for example metering pumps. The solutions may be introduced from a reservoir 9. Alternatively the solutions may be held in a cartridge prior to use. The cartridge can consist of part or all the processing solutions required to complete the process and is easily placed or "plugged in" the processor without the need to open or pour solutions. The cartridge can consist of an assembly of containers for each of the solutions required for the process. When required, merged solutions may be removed by suction or any other means. Residue of solutions therefore do not build up within the processing chamber. This results in the processing chamber being essentially self cleaning. The cross over times from one solution to another are very short.

It is possible to mount an infrared sensor outside of the chamber. The sensor monitors the silver density of the material during development thereof.

A wave forming mechanism is provided within the processing chamber. This wave forming mechanism sweeps the film surface and forms a wave of solution, primarily at the lowest point in the chamber. In the embodiment shown in FIG. 1 the mechanism is a free standing roller 10. It is possible that this roller may be held on a loose spindle, (not shown), which would allow the roller to be steered and also to be raised and lowered into position. The position of the roller can be changed with this mechanism so that it is to the left or right of bottom dead center which can be advantageous for the smooth running of the roller. It is also desirable to raise or lower the roller which might facilitate film loading. In operation a film cassette 4 is located in the arm 3 and held on the outside of the cylinder 1. The end of the film 5 is withdrawn from the cassette and entered into the processing chamber by means of the slot 6. The arm 21 holds the film against the inner circumference of the cylinder and the cylinder 1 is rotated so that the film 5 is unwound from the cassette and loaded into the processing chamber. The film is held in a circular configuration within the processing chamber. This loading is carried out while the processing chamber is dry although it is also possible to load the film if the chamber is wet. The film is held with the emulsion side facing inwards with respect to the chamber. It is also possible to load the film with the emulsion side facing outwards provided a gap is present between the film surface and the inner circumference of the chamber. Once loaded, the film is held by the edges thereof within the circular slot around the circumference of the chamber.

The processing chamber is heated. The chamber can be heated electrically or by hot air. Alternatively the chamber may be heated by passing the lower end thereof through a heated water bath. The chamber is then rotated. When the desired temperature is reached a given volume of a first processing solution is introduced into the chamber. The processing solution may be heated prior to being introduced into the chamber. Alternatively the solution may be unheated or cooled. As the chamber rotates the film is continuously re-wetted with the given volume of solution. Processing solution is added onto the roller 10 which is contacted across the whole width thereof by a spreader 52. This can be seen in more detail in FIG. 2. The spreader may be made of flexible soft plastic, rigid plastic or any other suitable material. The roller 10 rotates in contact with the spreader 52. Processing solution is delivered, via a supply pipe, down the spreader to the region of contact between the roller and the spreader. This method forms a uniform bead of solution over the region of contact between the roller and the spreader that extends across the width of the roller 10. This allows uniform spreading of the processing solution onto the film 5 as it passes under the roller 10. It is also possible to add solutions very quickly by "dumping" a given volume into the chamber while it is rotating so that it immediately forms a "puddle" or wave in front of the roller. Yet another method is to add the processing solutions when the chamber is stationary to a region where there is no film or to a region where there is no image such as the fogged end of the film. The rotation of the chamber is then started after the solution has been added. The time interval between adding the solution and starting the rotation can be from zero to any desired hold time.

The roller 10 acts as a wave forming mechanism. This wave forming mechanism, in combination with the rotation of the chamber, provides very high agitation which gives uniform processing even with very active processing solutions. High agitation and mixing are required when only small volumes of solution are being used. If a large volume of solution is added to the chamber in the absence of a wave forming mechanism a "puddle" of solution is formed and spreading and agitation is achieved. However if a small volume of solution is added to the chamber in the absence of a wave forming mechanism then solution adheres to the film as the chamber rotates. There is no "puddle" formed and there is consequently no agitation or mixing and processing is slow and non-uniform. The agitation and mixing mechanism of the present invention, i.e. the wave forming mechanism, is sufficient to minimise density differences from the front to the back of the film.

Once the first stage of the processing is completed a given volume of the next processing solution or solid is then introduced into the chamber after the desired time and so on. When merged solution processing is complete, the merged solutions are removed. Finally, the wash solutions are added and removed. The normal mode of operation of the method of the invention is to perform the complete process cycle within the single processing space of the rotating chamber. The process cycle may be develop, stop, bleach, fix and wash. The processing solution for each stage is added to the chamber and left for the required time. The film 5 may be dried in-situ with hot air. The whole process cycle may thus be carried out within a single processing space. It is also possible to remove the film at any point in the cycle if desired and the rest of the process can be carried out externally, including drying. It is possible to carry out part of the process within the rotating chamber and part of the process outside the rotating chamber in another type of processing apparatus. The other type of processing apparatus can be a deep tank apparatus in which the film is transported through the tank by means of pairs of drive rollers. The other type of processing apparatus can also be a surface application device.

It can also be advantageous to carry out a truncated process in which one or more of the stages of a complete process cycle is omitted. Thus a truncated process consisting of develop, stop and wash could be carried out. The photographic image would contain undeveloped silver halide and developed silver and would be unsuitable for optical printing. However, the photographic image could be scanned and the digital image subjected to image processing algorithms to correct for the unwanted effects of the retained silver and silver halide. A satisfactory color print could then be digitally produced. The truncated process could be develop, stop and wash, or develop, stop, bleach and wash, or develop, stop, fix and wash.

The process cycle is almost instantly changeable and allows rapid processing of both film and paper. Very rapid processing may be achieved with simplified film structures, such as those intended for scan only.

EXAMPLES

The film used in the following experiments was a full multilayer color negative film made with bromo-iodide silver halide emulsions containing about 4% iodide. The order of the layers coated on clear film-base was as follows; a metallic silver anti-halation layer containing 355 mg/sq.meter of silver, three red sensitive layers containing a total of about 1393 mg/sq.meter of silver and cyan couplers, an interlayer which scavenges oxidised color developing agent, three green sensitive layers containing a total of about 1145 mg/sq.meter of silver and magenta couplers, an interlayer which scavenges oxidised color developing agent and also contains a yellow filter, two blue sensitive layers containing a total of about 1164 mg/sq.meter of silver and yellow couplers and finally a protective gelatin supercoat.

Example 1

In this example a comparison was made between the observed sensitometry for a film strip processed in a small single use processor by the method of the invention and one in which separate solutions were used for each stage. A film strip of 0.315 meters (12.5 inches) was processed in the small single use processor which can process uniformly with small volumes of about 12 ml/linear meter (342.9 ml/m$^2$) or more. The apparatus avoids the use of a large processing tank and uses total volumes about the same as the replenishment volumes used in large continuous processors. It is desired to process as much as it is possible with volumes which are less than 12 ml/linear meter (342.9/m$^2$) and still obtain satisfactory uniformity and good sensitometry. In this example the volume used in the first or developer stage was kept the same as that used to replenish large processing machines at 19 ml/linear meter (543 ml/m$^2$) of 35 mm film.

The process cycles were as follows.

TABLE 1a

| Process Cycle 1 (invention) | | |
|---|---|---|
| Stage | Time | Volume used(ml/linear meter) |
| Development | 3 min 15 seconds | 19 ml (543 ml/m$^2$) |
| Stop | 30 seconds | +3 ml (85.7 ml/m$^2$) |
| Bleach | 2 minutes | +3 ml (85.7 ml/m$^2$) |
| Fix | 2 minutes | +3 ml (85.7 ml/m$^2$) |
| Solution removal | | |
| Wash | 2 minutes | separately |

The total volume used excluding the wash stage is 28 ml/linear meter (800 ml/m$^2$), where ml/linear meter means ml/linear meter of 35 mm film.

A+ sign indicates that the previous solution was left in the tank and the next solution was added directly as a concentrated solution.

Process cycle 2 was a non-merged process in which larger volumes need to be added because the previous solution is removed before the next one is added.

TABLE 1b

| Process Cycle 2 (comparison) | | |
|---|---|---|
| Stage | Time | Volume used(ml/linear meter) |
| Development | 3 min 15 seconds | 19 ml (543 ml/m$^2$) |
| Stop | 30 seconds | 12 ml (342.9 ml/m$^2$) |
| Bleach | 2 minutes | 12 ml (342.9 ml/m$^2$) |
| Fix | 2 minutes | 12 ml (342.9 ml/m$^2$) |
| Wash | 2 minutes | separately |

Total volume excluding the wash stage is 55 ml/linear meter (1572 ml/m$^2$).

TABLE 1c

| Process Cycle 3 (comparison) | | |
|---|---|---|
| Stage | Time | Volume used(ml/linear meter) |
| Development | 3 min 15 seconds | 19 ml (543 ml/m$^2$) |
| Stop | 30 seconds | 2 liter |
| Bleach | 2 minutes | 2 liter |
| Fix | 2 minutes | 2 liter |
| Wash | 2 minutes | separately |

The development step was carried out in the single use processor whereas each of the stop, bleach, fix and wash steps were carried out separately in separate tanks.

TABLE 1d

| Process Cycle 4 (comparison) | | |
|---|---|---|
| Stage | Time | Volume used(ml/linear meter) |
| Development | 3 min 15 seconds | 19 ml (543 ml/m$^2$) |
| Stop | 30 seconds | 2 liter |
| Fix | 2 minutes | 2 liter |
| Wash | 2 minutes | separately |

The development step was carried out in the single use processor whereas each of the stop, fix and wash steps were carried out separately in separate tanks. In this case there was no bleach step to show the effect of retained silver.

The solution used for the developer stage in the processes described above is shown in Table 1e.

TABLE 1e

| Developer composition | |
|---|---|
| Component | Concentration(per liter) |
| Sodium bromide | 0.378 g |
| DTPANa$_5$(40%) | 7.65 g |
| Sodium metabisulfite | 4.52 g |
| $K_2CO_3$ | 33.75 g |
| HAS | 3.40 g |
| CD4 | 5.88 g |
| KOH | to pH = 10.17 |

DTPANa$_5$(40%) is a 40% solution of the penta sodium salt of diethylene triamine penta acetic acid, HAS is hydroxylamine sulfate, CD4 is 4-amino-3-methyl-N-ethyl-N-(hydroxyethyl)anilne sulfate.

The solution used for the stop bath was 200 g/l sulfamic acid.

The solution used for the bleach concentrate is shown in Table 1f.

TABLE 1f

| Bleach composition | |
|---|---|
| Component | Concentration(g) |
| Succinic acid | 97.6 |
| Ammonium bromide(38%) | 192.6 |
| Ammonium hydroxide(20%) | 157.5 |
| PDTA | 110.5 |
| AC3 | 1.2 |
| Ferric nitrate(39%) | 218.5 |
| Water to | 1 liter |

Ammonium bromide(38%) is 38 g of ammonium bromide in 100 g of aqueous solution, ammonium hydoxide(20%) is 20 g of ammonium hydroxide in 100 g of aqueous solution, PDTA is 1,3-propylene diamine tetra acetic acid, AC3 is 2-hydroxy-1,3-propylene diamine tetra acetic acid and ferric nitrate(39%) is 39 g of ferric nitrate in 100 g of aqueous solution.

TABLE 1g

| Fixer composition(concentrate) | |
|---|---|
| Component | Concentration(g) |
| Ammonium thiosulfate(56.5%) | 399.5 |
| Ammonium thiocyanate(50%) | 360.0 |
| EDTA | 1.7 |
| Sodium sulfite anhydrous | 28.0 |
| Sodium hydroxide(47%) | 3.5 |
| Acetic acid(90%) | 1.0 |
| Water to | 1 liter |

Figure 3:
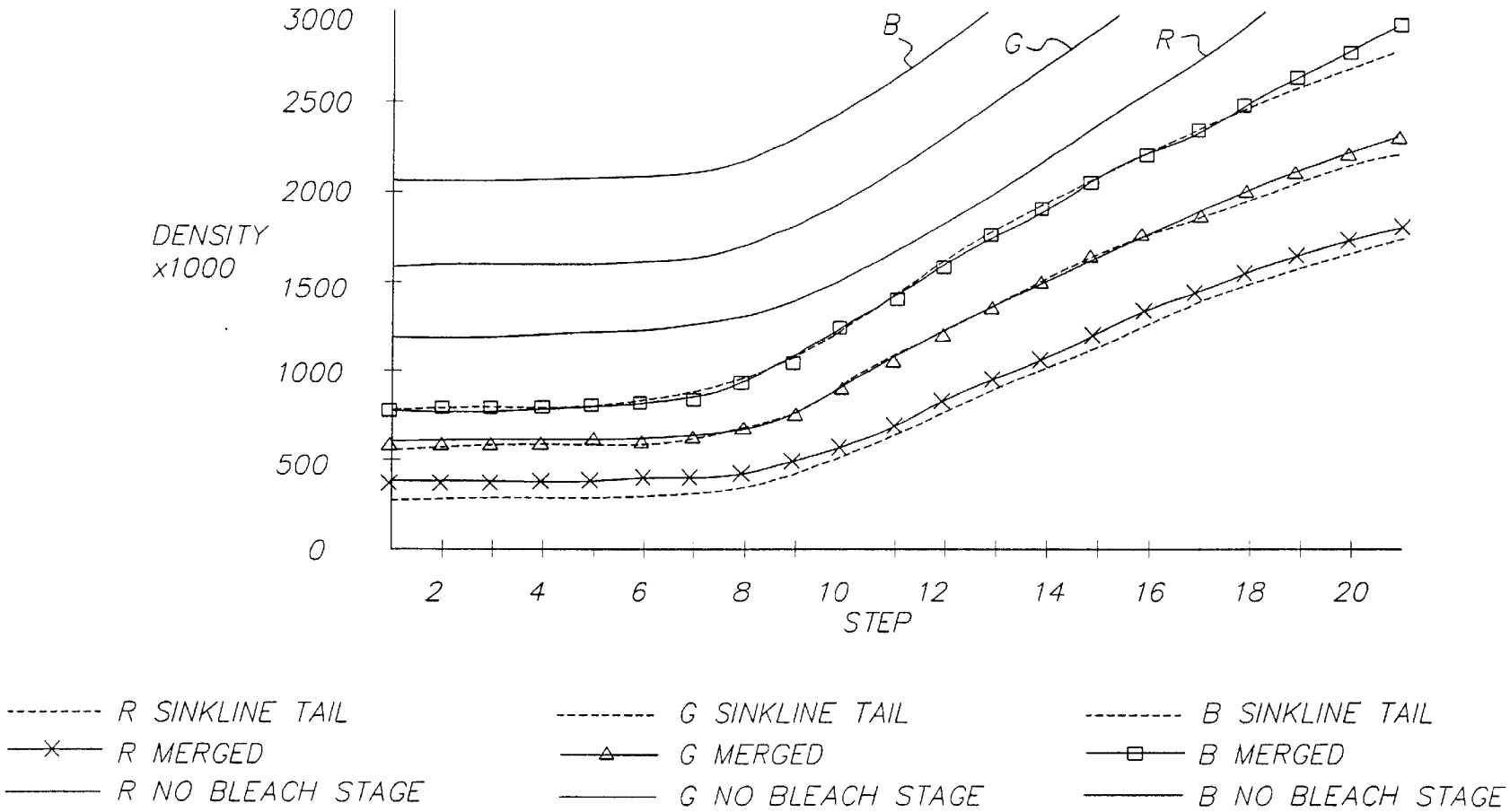
FIGS. 3 and 4 are graphical illustrations of results obtained from the experiments described in Example 1.

In FIG. 3, the sensitometric curves for Process Cycle 1 (the invention) are compared with the check process, Process Cycle 3, in which development is carried out in the small single use processor so that this part of the process is identical to that of the invention but where the rest of the process is performed in a normal row of tanks consisting of 2 liter tanks. Also in FIG. 1*a* are the curves for Process Cycle 4 in which the bleach step was omitted. It can be seen that there is a close agreement between the invention and the check process and that there is no retained silver compared to Process Cycle 4. This shows that the stop, bleach and fix stages can all be performed satisfactorily in the small single use processor by retaining the previous solution and adding a concentrated solution to generate the next stage. This demonstrates the invention.

Figure 4:
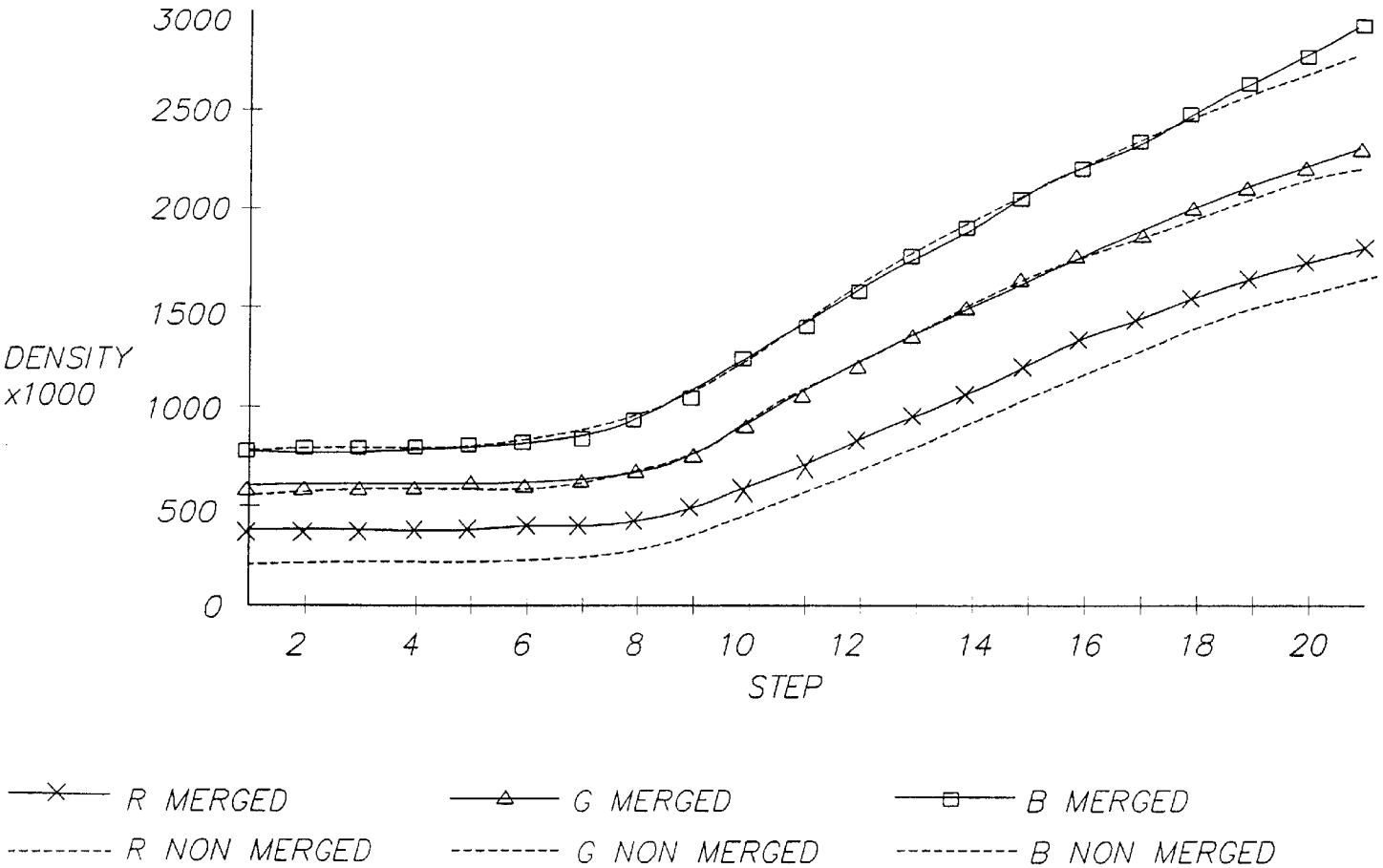

In FIG. 4 the merged process, Process cycle 1, is compared with the non-merged process, Process cycle 2. Bleaching and fixing is complete in the merged process compared with the non-merged process.

Example 2

In this example a new sequence for the process cycle is used as shown in Table 2a.

TABLE 2a

| Merged Process Cycle(A) (Invention) | | |
|---|---|---|
| Developer | 30 sec | 19.8 ml/linear meter (566 ml/m$^2$)(35 mm film) |
| Stop/fix | 40 sec | 13.2 ml/linear meter (377 ml/m$^2$) |
| Bleach solution removal | 30 sec | 13.2 ml/linear meter (377 ml/m$^2$) |
| washes | 40 sec | 4 × 13.2 ml/linear meter (4 × 377 ml/m$^2$) |
| Total | 140 sec | 99 ml/linear meter (2829 ml/m$^2$) |

Figure 2:
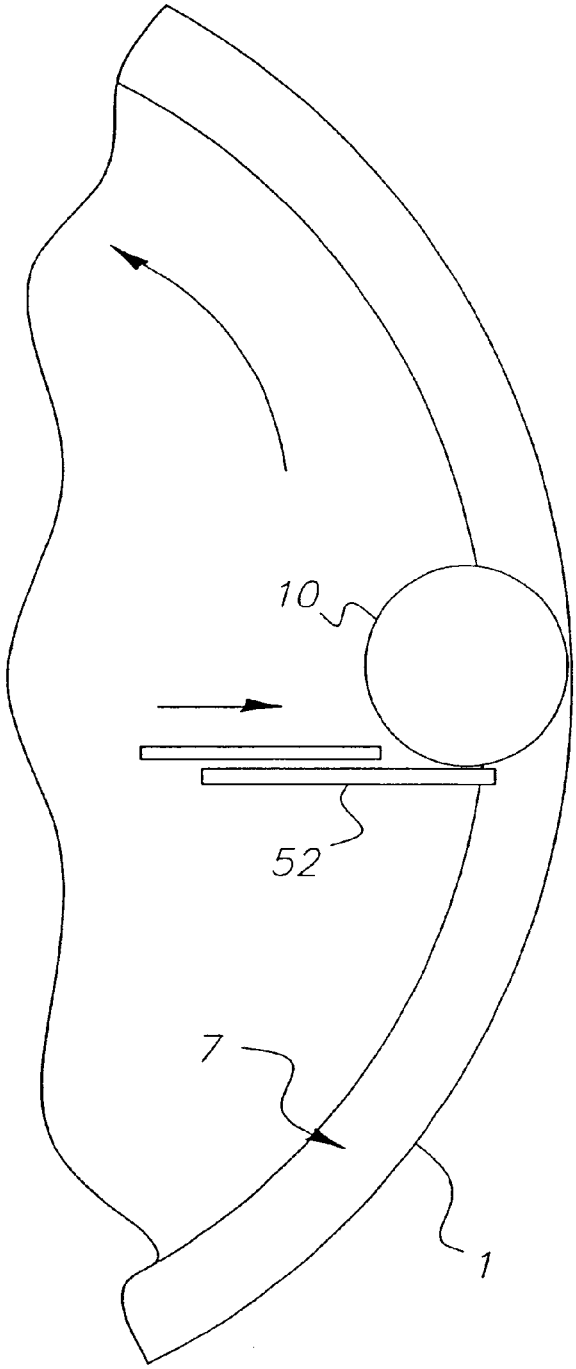
FIG. 2 is an enlarged view of the lower portion of the embodiment shown in FIG. 1.

This process was carried out in a small rotary single use processor of the type shown in FIGS. 1 and 2 in which small volumes equivalent to those used to replenish large tank conventional processors are used to process the film. There is no other volume required and so the film is essentially processed in replenishment volumes which are then discarded. There is thus no need for large standing tanks if this apparatus is used. Thus novel process cycles can be used which are not possible in conventional processors. In the process cycle above the stop/fix is added on top of the developer without removing the developer solution and the two solutions are mixed together. The bleach is added on top of the developer plus stop/fix and the two(now three) solutions are mixed together without removing the developer plus stop/fix solution.

A check process was run in the same small rotary single use processor in which a more conventional process cycle was used and this is shown in Table 2b.

TABLE 2b

| Process Cycle(B) (Comparison) | | |
|---|---|---|
| Developer | 30 sec | 19.8 ml/linear meter (566 ml/m$^2$) (35 mm film) |
| Stop | 10 sec | 13.2 ml/linear meter (377 ml/m$^2$) |
| Solution removal leach | 30 sec | 19.8 ml/linear meter (566 ml/m$^2$) |
| Solution removal Fix | 50 sec | 19.8 ml/linear meter (566 ml/m$^2$) |
| Solution removal | 40 sec | 4 × 13.2 ml/linear meter (4 × 377 ml/m$^2$) |
| Washes | | |
| Total | 160 sec | 125.4 ml/linear meter (3584 ml/m$^2$) |

where the developer composition is shown in Table 2c.

TABLE 2c

| Developer composition | | |
|---|---|---|
| $Na_2SO_3$(anhydrous) | 10.53 | g/l |
| HAS | 3.0 | g/l |
| DTPA(solid) | 2.6 | g/l |
| KI | 0.002 | g/l |

TABLE 2c-continued

| Developer composition | | |
|---|---|---|
| PVP(K15) | 3 | g/l |
| NaBr | 2.8 | g/l |
| $Na_2CO_3$ | 30.7 | g/l |
| CD4 | 15 | g/l |
| pH | 10.48 | |
| photoflo | 40 | drops/l |

where HAS is hydroxylamine sulfate, DTPA is diethylene triamine penta acetic acid, PVP is polyvinyl pyrrolidone, CD4 is CD4 is 4-amino-3-methyl-N-ethyl-N-(β-hydroxyethyl)aniline sulfate and photoflo is a commercially available wetting agent.

The composition of the Stop/fixer used in Process Cycle (A) is shown on Table 2d. The same fixer was used in Process Cycle(B) except that the pH was 7.9. The Stop solution in Process Cycle(B) was 10% acetic acid.

TABLE 2d

| Stop/fixer | | |
|---|---|---|
| Ammonium sulfite | 21.5 | g/l |
| ammoniumthiosulfate | 264 | g/l |
| EDTA.$Na_2$2$H_2O$ | 1.08 | g/l |
| MT(KAN 909346-0) | 1.0 | g/l |
| pH | 4.25 | |
| photoflo | 40 | drops/l |

where EDTA.$Na_2$.2$H_2O$ is ethylenediamine tetra acetic acid disodium salt dihydrate amd MT is 3-mercapto-1,2,4-triazole.

The bleach composition is shown in Table 2e

TABLE 2e

| Bleach composition(Process Cycle A) | | |
|---|---|---|
| Components | 1 | liter Bleach |
| mls Water | 300.0 | |
| grams 1,3-PDTA (MW 306.24) | 156.8 | |
| grams Succinic Acid (MW 118.09) | 105.0 | |
| To the above add: | | |
| grams Fe(NO3)3*9H2O (FW 404) | 188.1 | |
| in mls Water, alternately in portions with NH4OH (approx. 200 mL) until complete solution is obtained, pH approx. 4.7) | 100.0 | |
| Bring to a Volume of: | 950 mL | |
| Components with Water | 1 | liter Bleach |
| pH Adjust to: with HNO3 or NH4OH | 4.75 | |
| Bring to Final Volume of: | 1.0 | liters |
| photoflo | 40 | drops/l |

where 1,3-PDTA is 1,3-propylenediamine tetra acetic acid.

The bleach used in Process Cycle(B) was the same as that in Table 2e except for the inclusion of 60 g/l of ammonium bromide.

Figure 5:
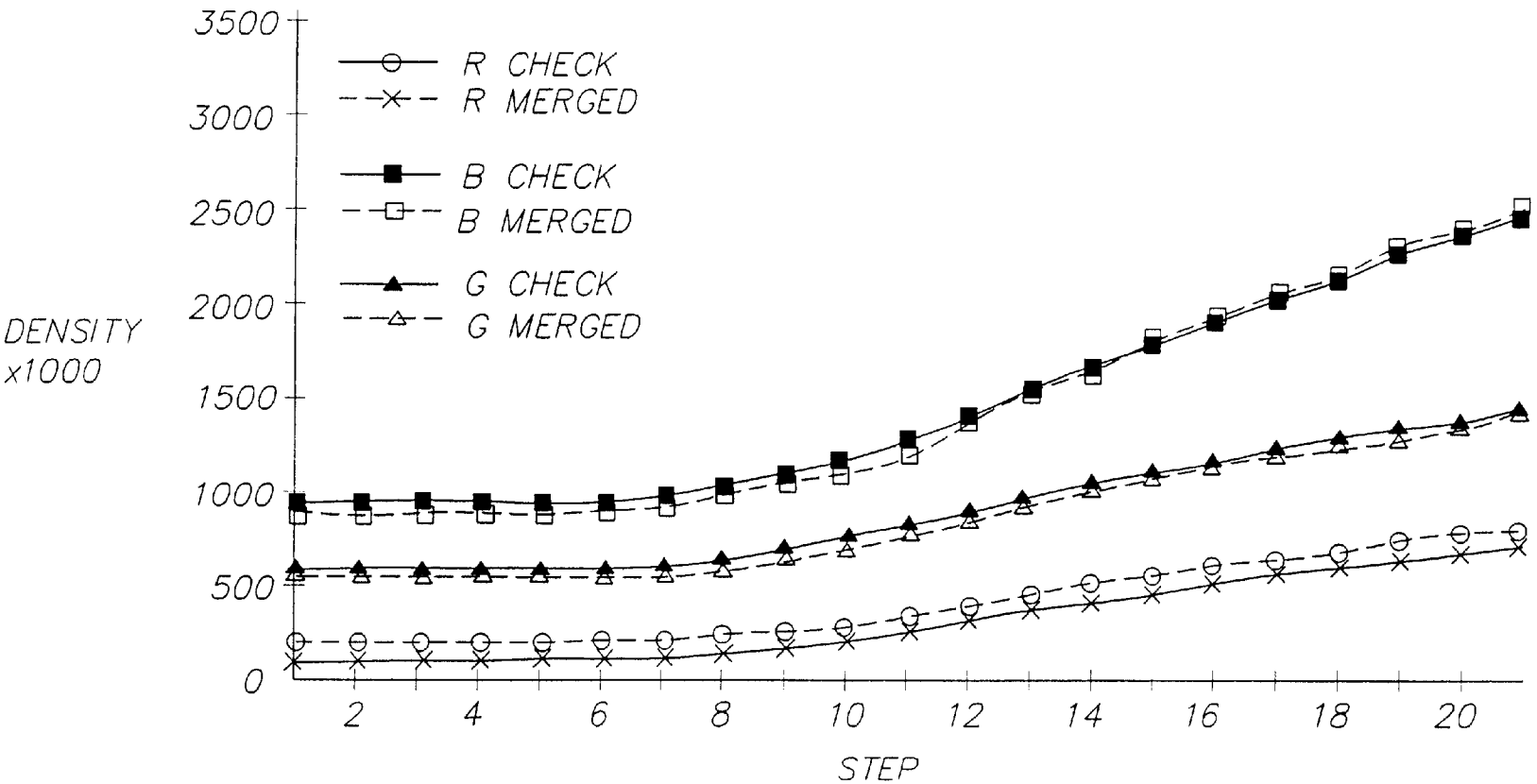
FIG. 5 is a graphical illustration of results obtained from the experiments described in Example 2.

The results are shown in FIG. 5.

It can be seen from FIG. 5 that the Merged Process(A) is close to the Check Process(B). Thus the invention has been demonstrated. It is also apparent that the Merged Process(A) uses less volume i.e. 99 ml/linear meter(30 ml/linear foot) compared with the check Process(B) which uses 125.4 ml/linear meter (38 ml/linear foot). Thus a major advantage of the invention is demonstrated. The Merged Process(A) is also more rapid taking 140 seconds compared with the Check Process(B) which takes 160 seconds. Thus a second advantage of the invention is demonstrated. A third advantage of the invention is that two removal steps are avoided compared with the Check Process(B) making the process much simpler and more reliable to operate. In fact no solution removal steps are required until the active part of the process cycle is complete. The first solution removal step that is required is just before the wash stage. A fourth advantage of the invention is that the fixer component is diluted by both the developer solution and the bleach solution and because of this the fix concentration in the solution before the wash is lowered to about ¼× of that in the Check Process(B). Since this solution is removed and the residual solution left in the processor chamber is about 3.3 ml/linear meter (1 ml/linear foot) of 35 mm film for both Process cycle(A) and Process Cycle(B) the amount of fixer needed to be removed by the wash is thus ¼× in Process Cycle(A). Since fixer is the main component to cause sensitometric problems the potential for contamination of the next film to be processed is much reduced.

Example 3

This is a Comparative Example

In this example a one meter strip of 35 mm film is processed in a small thin tank of 70 ml volume. The process cycle is described in Table 3.

TABLE 3

Processing Cycle

| Stage | Time | Tank Volume |
|---|---|---|
| Develop | 3 minutes 15 sec | 70 ml/linear meter (2000 ml/m$^2$) |
| Stop | 30 seconds | 70 ml |
| Bleach | 3 minutes 30 seconds | 70 ml |
| Fix | 4 minutes 30 seconds | 70 ml |
| Wash | 2 minutes 20 seconds | 4 × 70 ml |

where the developer is Kodak Flexicolor C-41 developer, the Stop is 5% acetic acid, the Bleach is Kodak Flexicolor Bleach III and the Fix is Kodak Flexicolor fixer. The wash is either water or Kodak Flexicolor Stabiliser. The small tank is emptied after each stage and the next processing solution is added until the final wash after which it is dried.

The total volume used to process a one meter length of 35 mm film is 560 ml (16,004 ml/m$^2$). This example illustrates a simple single use process with a small thin tank into which a film strip is dipped.

Example 4

This is an Example of the Invention

In this example a one meter strip of 35 mm film is processed in a small tank of 70 ml volume as used in Example 3. The process cycle is described in Table 4.

TABLE 4

Processing Cycle

| Stage | Time | Tank Volume or Volume added |
|---|---|---|
| Develop | 3 minutes 15 sec | 70 ml/linear meter (2000 ml/m$^2$) |
| Stop | 30 seconds | +2.0 ml of concentrated stop (57.16 ml/m$^2$) |
| Bleach | 3 minutes 30 sec | +8 ml of concentrated bleach (228.6 ml/m$^2$) |
| Fix | 4 minutes 30 sec | +8 ml of concentrated fix (228.6 ml/m$^2$) |
| Wash | 2 minutes 20 sec | 4 × 70 ml (4 × 2000 ml/m$^2$) |

In this example the small tank is not emptied after the developer stage but the next solution is made by adding a small volume of a concentrated solution, as indicated by the + sign, to the bottom of the tank by means of an inlet pipe followed by vigorous mixing. This procedure is repeated for each stage until the wash stage when the tank is filled and emptied four times.

The total volume used to process a one meter length of film is 368 ml (10,517 ml/m$^2$), a saving of 192 ml (5487 ml/m$^2$) compared with Example 3.

Example 5

This is a Comparative Example

In this example a processing sequence as in Table 5 is carried out in a conventional continuous processing machine which consists of separate tanks for each stage. Each stage of the process is replenished according to the volumes shown in Table 5. The tank volumes are also shown in Table 5. The tank volumes shown are modest and can be any volume from a few liters upwards.

TABLE 5

Processing Cycle

| Stage | Time | Replenishment Volume (ml/linear meter of 35 mm film) | Tank Volume |
|---|---|---|---|
| Develop | 3 minutes 15 sec | 19 ml (543 ml/m$^2$) | 5 liters |
| Stop | 30 seconds | 19 ml (543 ml/m$^2$) | 5 liters |
| Bleach | 3 minutes 30 seconds | 32 ml (914.5 ml/m$^2$) | 5 liters |
| Fix | 4 minutes 30 seconds | 32 ml (914.5 ml/m$^2$) | 5 liters |
| Wash | 2 minutes 20 seconds | 36 ml (914.5 ml/m$^2$) | 4 × 5 liters |

The total replenishment volume used to process one meter of film is 138 ml. This either goes to waste or can be subjected to various recovery and treatment methods. This method also requires relatively large volume tanks of the order of several liters through which the film passes and which stand idle when film is not being processed.

Example 6

This is a Comparative Example

In this example the same processing cycle as in examples 3, 4 and 5 is used but the processing is done in a a low volume wave processor which allows each stage to be carried out in only the replenishment volume without large volume static tanks. In this apparatus the vessel containing the processing solutions is empty at the start of the process cycle and is then filled and emptied for each stage.

TABLE 6

Processing Cycle

| Stage | Time | Replenishment Volume (ml/linear meter of 35 mm film) |
|---|---|---|
| Develop | 3 minutes 15 sec | 19 ml (543 ml/m$^2$) |
| Stop | 30 seconds | 13.2 ml (377 ml/m$^2$) |
| Bleach | 3 minutes 30 seconds | 13.2 ml (377 ml/m$^2$) |
| Fix | 4 minutes 30 seconds | 13.2 ml (377 ml/m$^2$) |
| Wash | 2 minutes 20 seconds | 4 × 9 ml |

The total volume used to process one meter of film is 94.6 ml (2703 ml/m$^2$). Thus the replenishment volume can be used to process film without the need for large static tanks.

Example 7

This is an Example of the Invention

In this example the same processing cycle as in Examples 5 and 6 is used but the processing is done in a low volume wave processor which allows each stage to be carried out in only the replenishment volume without the need for large static tanks as described in Example 6. In addition, the preceding solution is left in the vessel and is used to generate the next solution by adding a concentrated solution which contains all the components necessary to form the next solution.

TABLE 7

| Stage | Time | Processing Cycle Replenishment Volume (ml/linear meter of 35 mm film) |
|---|---|---|
| Develop | 3 minutes 15 sec. | 19 ml (543 ml/m$^2$) |
| Stop | 30 sec. | +3.3 ml (94.3 ml/m$^2$) of concentrated stop (200 g/l sulphamic acid) |
| Bleach | 3 minutes 30 sec. | +3.3 ml (94.3 ml/m$^2$) of concentrated bleach |
| Fix | 4 minutes 30 sec. | +3.3 ml (94.3 ml/m$^2$) of concentrated fix |
| Wash | 2 minutes 20 sec. | 4 × 9 ml |

The + sign indicates a volume that is added to the previous solution without any emptying. The wave processor is emptied prior to the addition of 4 aliquots of wash solution.

Thus the total volume used is 64.9 ml/linear meter (1854 ml/m$^2$) a saving of 29.7 ml/linear meter (848.8 ml/m$^2$) compared with Example 6.

Example 8

This is an Example of the Invention

In this example the replenishment rates are lowered to the lowest currently possible. The process is done in a low volume wave processor which allows each stage to be carried out in only the replenishment volume without the need for large static tanks. The preceding solution is left in the vessel and the next solution is made by adding concentrated components as indicated by the + sign.

TABLE 8

| Stage | Time | Processing Cycle Replenishment Volume (ml/linear meter of 35 mm film) |
|---|---|---|
| Develop | 3 minutes 15 sec. | 6.6 ml (188.6 ml/m$^2$) |
| Stop | 30 sec. | +1.0 ml (28.5 ml/m$^2$) of concentrated stop (200 g/l sulphamic acid) |
| Bleach | 3 minutes 30 sec. | +2.7 ml (77.2 ml/m$^2$) of concentrated bleach |
| Fix | 4 minutes 30 sec. | +7.55 ml (215.8 ml/m$^2$) of concentrated fix |
| Wash | 2 minutes 20 sec. | 4 × 6.6 ml (4 × 188.6 ml/m$^2$) |

The total volume used to process one meter of film is 44.25 ml per linear meter (1264.6 ml/m$^2$) of 35 mm film. This is significantly less than that in Example 5. This volume is also less than that for the Kodak Flexicolor SM process which is about 57.97 ml (1656 ml/m$^2$).

Example 9

This is an Example of the Invention

In this example the process cycle used in Example 8 is used except that the preceding solution is converted into the next solution by adding a solid component which is rapidly dissolved because of the high agitation in the single use low volume wave processor.

TABLE 9

| Stage | Time | Processing Cycle Replenishment Volume (ml/linear metre of 35 mm film) |
|---|---|---|
| Develop | 3 minutes 15 sec | 6.6 ml (188.6 ml/m$^2$) |
| Stop | 30 seconds | +0.2 g sulphamic acid solid stop |
| Bleach | 3 minutes 30 sec. | +0.5 g solid bleach |
| Fix | 4 minutes 30 sec. | +0.5 g solid fixer |
| Wash | 2 minutes 20 sec. | 4 × 6.6 ml (4 × 188.6 ml/m$^2$) |

Thus the total volume used is 33 ml which is considerably less than that in Example 8.

Example 10

This is an Example of the Invention

In this example the process cycle shown in Table 10 was carried out.

TABLE 10

| | | Process Cycle (D) |
|---|---|---|
| Developer | 30 seconds | 19.8 ml/linear metre (566 ml/m$^2$) |
| Fix | 40 seconds | 13.2 ml/linear metre (377 ml/m$^2$) |
| Bleach | 30 seconds | 13.2 ml/linear metre (377 ml/m$^2$) |
| Solution removal | | |
| Washes | 4 × 10 seconds | 4 × 13.2 ml/linear metre (4 × 377 ml/m$^2$) |
| Total | 140 seconds | 99 ml/linear meter (2829 ml/m$^2$) |

where ml/linear meter means ml/linear meter of 35 mm film.

The developer composition used is that shown in Table (2c), the fixer used is shown in Table(2d) except that the pH was 7.9 and the bleach used is shown in Table(2e). In this example the fixer was used at a pH of 7.9 which is the pH at which it is used when it follows a bleach stage. This only has a small effect in lowering the pH of the developer plus fix mixture and development is arrested mainly by the rapid removal of silver halide by the fixing reaction.

Figure 6:
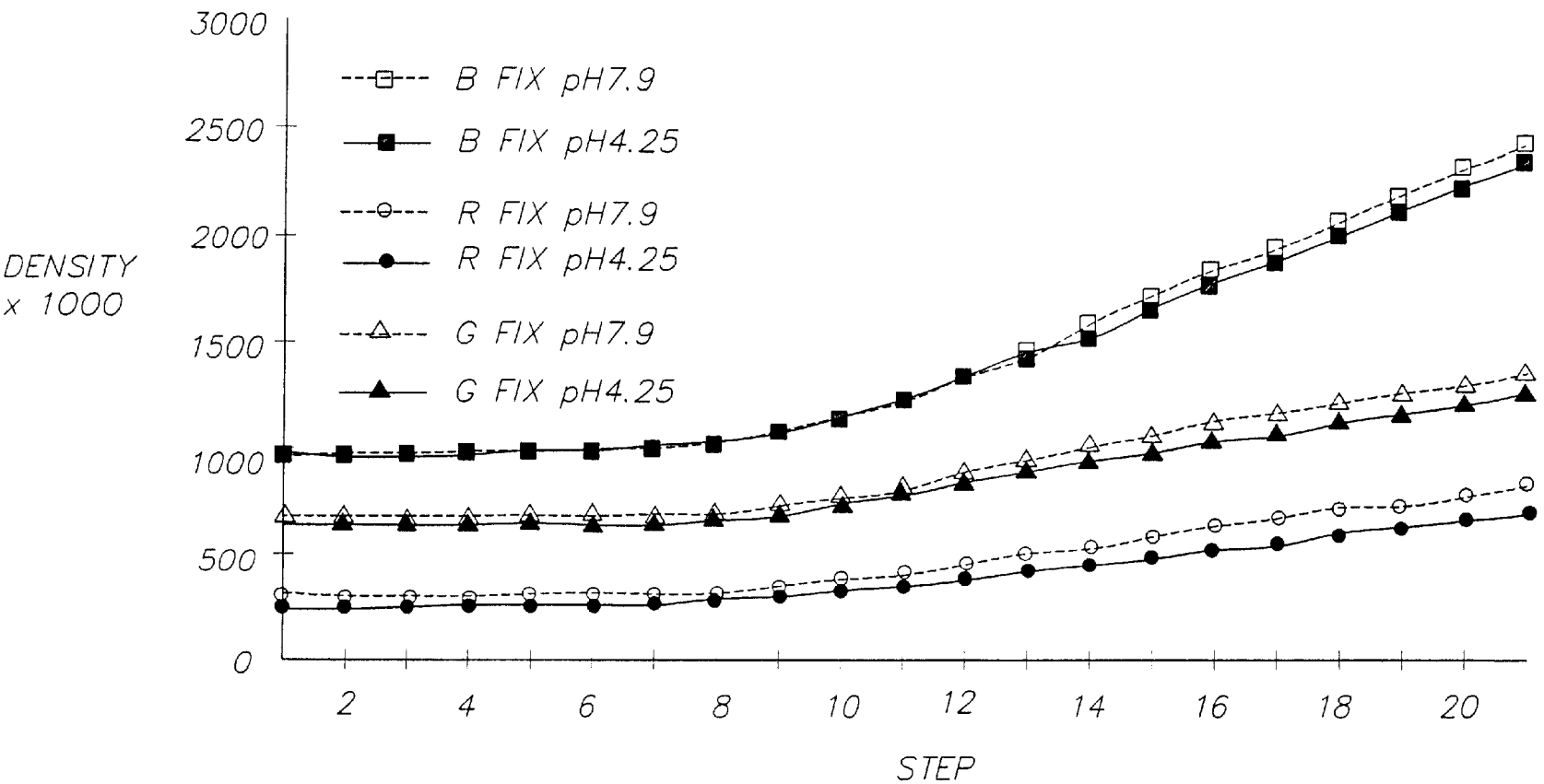
FIG. 6 is a graphical illustration of results obtained from the experiments described in Example 10.

The result is shown in FIG. 6 in which Process Cycle(D) is compared with Process Cycle(A) of Example 2. It can be see from FIG. 6 that the fixer used at its normal pH of 7.9 gives slightly higher densities than when used at pH of 4.25. Thus it is possible to use just a fix solution instead of a stop/fix solution to arrest development and initiate the fixing stage of the process. Thus a further example of the invention has been demonstrated.

Example 11

This is an Example of the Invention

In this example the merged process is combined with a two stage developer. That is the developer is made in a single use wave processor, which contains a pre-loaded film, by first adding Part 1 of the developer (an alkaline part which does not contain the color developing agent) followed after a pre-determined time $t_1$ by Part 2 of the developer which contains the color developing agent and which is left to process for an additional pre-determined time $t_2$. The total time for the developer stage is $t_1+t_2$. The addition of Part 1 of the developer forms a "wave" or puddle next to an agitation roller. Part 2 of the developer must be added to the wave formed by the addition of Part 1 such that the two parts mix rapidly and form a homogeneous mixture. The other stages of the process cycle are carried out without removing the developer solution according to Process Cycle(E) shown in Table(11).

TABLE 11

| | | Process Cycle (E) |
|---|---|---|
| Developer Part (1) | 5 seconds | 17.69 ml/linear metre (505.7 ml/m$^2$) |
| Developer Part (2) | 25 seconds | 2.11 ml/linear metre (60.4 ml/m$^2$) |
| Stop/fix | 10 seconds | 13.2 ml/linear metre (377 ml/m$^2$) |
| Bleach | 60 seconds | 13.2 ml/linear metre (377 ml/m$^2$) |
| Solution removal | | |
| Washes | 4 × 10 seconds | 4 × 13.2 ml/linear metre (377 ml/m$^2$) |
| Total | 140 seconds | 99 ml/linear metre (2829 ml/m$^2$) |

where the developer composition is shown in Table (12)

TABLE 12

| Components | Developer composition Part (1) | Part (2) |
|---|---|---|
| $Na_2SO_3$(anhydrous) | 10.81 g/l | |
| HAS | 3.36 g/l | |
| DTPA | 2.9 g/l | |
| PVP (K15) | 3.36 g/l | |
| KI | 0.0024 g/l | |
| NaBr | 3.14 g/l | |
| $K_2CO_3$ | 44.8 g/l | |
| $Na_2S_2O_5$ | 0 | 7 g/l |
| CD4 | 0 | 140 g/l |
| pH | 12.84 | — |
| Photoflo | 1 ml/l | 1 ml/l |

HAS is hydroxylamine sulfate, DTPA is diethylene triamine penta acetic acid, PVP(K15) is polyvinylpyrrolidone, CD4 is 4-amino-3-methyl-N-ethyl-N-(β-hydroxyethyl) aniline sulfate, Photoflo is a commercially available surfactant.

The stop/fix used in this example is shown in Table(2d) and the bleach in Table(2e).

Figure 7:
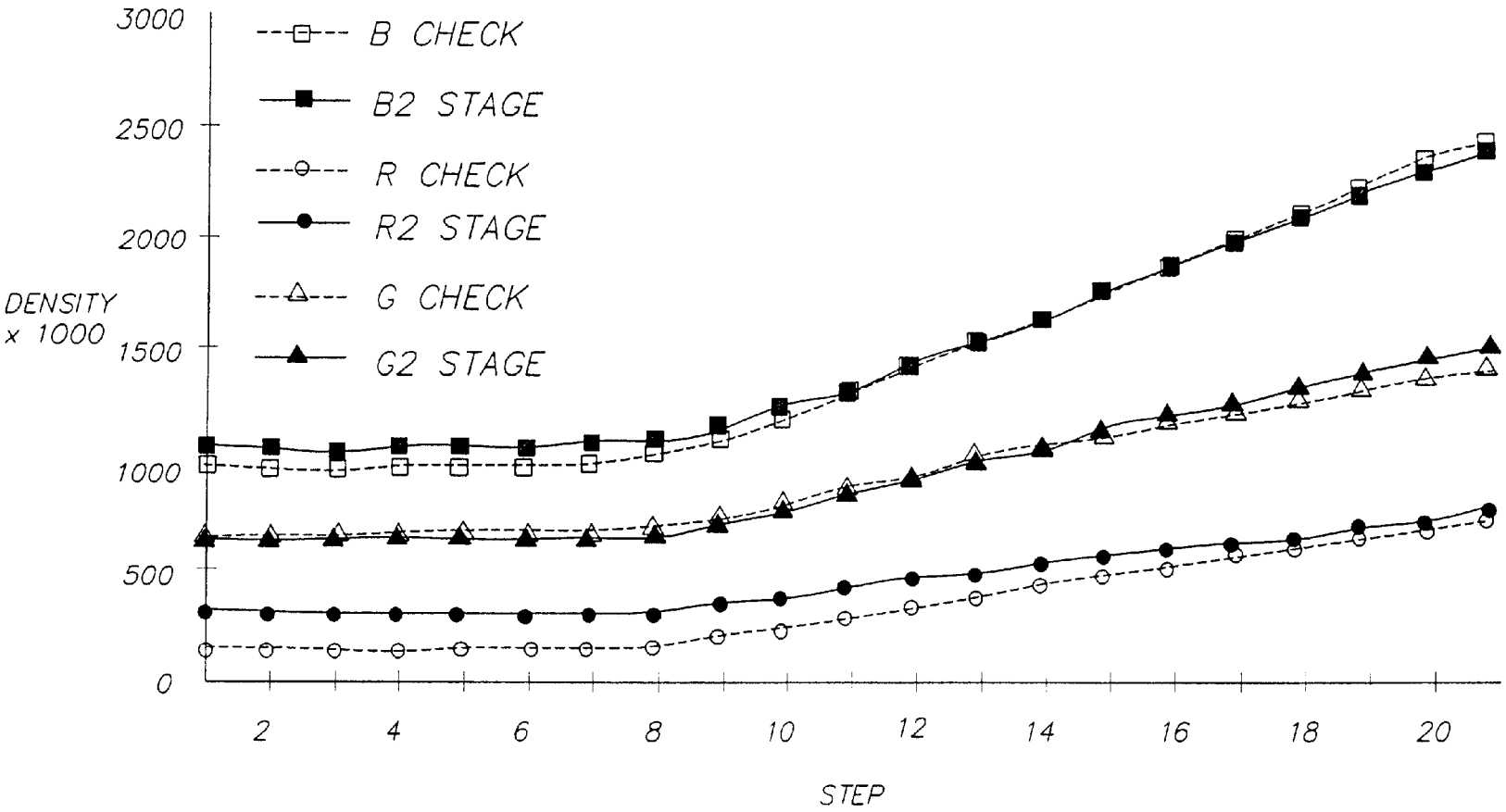
FIG. 7 is a graphical illustration of results obtained from the experiments described in Example 11.

The results are shown in FIG. 7 where it can be seen that in this case the two stage development is similar to the check apart from higher blue and red Dmin.

It is clear from the preceding Examples that the total volume needed to process film can be significantly reduced by the method of the invention.

The invention has been described in detail with particular reference to certain preferred embodiments thereof, but it will be understood that variations and modifications can be effected within the spirit and scope of the invention.

What is claimed is:

1. A method for processing a silver halide photographic material comprising the steps of loading the material into a chamber adapted to hold the material therein, introducing a metered amount of a first processing solution into the chamber, processing the photographic material with the first processing solution, introducing a metered amount of a second processing solution which is other than a second part of the first processing solution into the chamber without removing the first processing solution so that at least part of the total volume of the second processing solution is provided by the first processing solution and processing the photographic material with the second processing solution, the total volume of solution for each processing stage being spread over the whole area of the photographic material in a repetitive manner to enable uniform processing.

2. A method according to claim 1 which further comprises, after processing the photographic material with the second processing solution, introducing a metered amount of a third processing solution into the chamber without removing any processing solution remaining from the preceding processing solution or solutions so that at least part of the total volume of the third processing solution is provided by the preceding processing solution or solutions and processing the photographic material with the third processing solution.

3. A method according to claim 2 which further comprises, after processing the photographic material with the third processing solution, introducing a metered amount of a fourth processing solution into the chamber without removing any processing solution remaining from the preceding processing solution or solutions so that at least part of the total volume of the fourth processing solution is provided by the preceding processing solution or solutions and processing the photographic material with the fourth processing solution.

4. A method according to claim 1 wherein the first processing solution is a developer solution and the second processing solution arrests development.

5. A method according to claim 4 wherein the second processing solution is a stop solution.

6. A method according to claim 5 wherein the third processing solution is a bleach solution.

7. A method according to claim 6 wherein the fourth processing solution is a fix or bleach-fix solution.

8. A method according to claim 4 wherein the second processing solution is a stop-fix or fix solution.

9. A method according to claim 8 wherein the third processing solution is a bleach solution.

10. A method according to claim 4 wherein the second processing solution is a stop-bleach or bleach solution.

11. A method according to claim 10 wherein the third processing solution is a bleach-fix or fix solution.

12. A method according to claim 4 wherein the second processing solution is a bleach-fix solution.

13. A method according to claim 1 wherein the second processing solution is made by adding a solid to the first processing solution.

14. A method according to claim 13 wherein a third processing solution is is made by adding a solid to the second processing solution.

15. A method according to claim 14 wherein a fourth processing solution is is made by adding a solid to the third processing solution.

16. A method according to claim 1 wherein photographic material is a colour negative film and the amount of the first processing solution is from 50 to 2850 ml/m$^2$.

17. A method according to claim 16 wherein the amount of the second, third or fourth processing solution is sufficient to provide an additional volume of from 6 to 2000 ml/m$^2$.

* * * * *